US008443469B2

(12) United States Patent
Leibfried

(10) Patent No.: US 8,443,469 B2
(45) **Date of Patent: *May 21, 2013**

(54) TOILET AND TOILET SEAT MOUNTING SYSTEM

(76) Inventor: Michael R. Leibfried, Lancaster, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/336,914

(22) Filed: Dec. 23, 2011

(65) Prior Publication Data

US 2012/0151665 A1 Jun. 21, 2012

Related U.S. Application Data

(63) Continuation of application No. 11/899,891, filed on Sep. 7, 2007, now Pat. No. 8,082,603, which is a continuation-in-part of application No. 11/581,900, filed on Oct. 17, 2006, now Pat. No. 8,087,103.

(60) Provisional application No. 60/729,084, filed on Oct. 21, 2005.

(51) Int. Cl.
*A47K 13/00* (2006.01)

(52) U.S. Cl.
USPC ..... 4/234

(58) Field of Classification Search
USPC ..... 4/234–242.1
See application file for complete search history.

(56) References Cited

U.S. PATENT DOCUMENTS

| | | | |
|---|---|---|---|
| 651,354 | A | 6/1900 | Hogan |
| 2,004,023 | A | 6/1935 | Uffen |
| 2,434,249 | A | 1/1948 | Olson et al. |
| 2,593,534 | A | 4/1952 | Campanelli |
| 2,849,728 | A | 9/1958 | Gyllenberg |
| 3,055,015 | A | 9/1962 | Silverman |
| 3,063,063 | A | 11/1962 | Brooks |
| 3,262,481 | A | 7/1966 | Hanfland |
| 3,550,164 | A | 12/1970 | Pease |
| 3,613,130 | A | 10/1971 | Sansone |
| 3,623,767 | A | 11/1971 | Condon |
| 4,087,884 | A | 5/1978 | Seiderman |

(Continued)

FOREIGN PATENT DOCUMENTS

| | | |
|---|---|---|
| CA | 2305976 | 10/2001 |
| CA | 2368806 | 7/2003 |

(Continued)

OTHER PUBLICATIONS

International Search Report and Written Opinion for PCT/US2007/80176, mailed Apr. 15, 2008.

(Continued)

*Primary Examiner* — Lori Baker
(74) *Attorney, Agent, or Firm* — Foley & Lardner LLP

(57) ABSTRACT

A mount for a toilet seat includes a first elongate post configured to be secured to a first post holder; a second elongate post configured to be secured to a second post holder; a first hinge pin configured to join the toilet seat and the first post holder; a second hinge pin configured to join the toilet seat and the second post holder; a first post receptacle configured to be secured in a first aperture of a toilet bowl flange; and a second post receptacle configured to be secured in a second aperture of the toilet bowl flange.

4 Claims, 10 Drawing Sheets

U.S. PATENT DOCUMENTS

| | | | | |
|---|---|---|---|---|
| 4,173,802 | A | 11/1979 | Wikstrom | |
| 4,291,422 | A | 9/1981 | Shoemaker et al. | |
| 4,326,307 | A | 4/1982 | Baillie et al. | |
| 4,367,567 | A | 1/1983 | Sendoykas | |
| 4,639,147 | A | 1/1987 | Schwarz | |
| 4,884,841 | A | 12/1989 | Holley | |
| 4,970,731 | A | 11/1990 | Fait | |
| 4,974,262 | A | 12/1990 | Rosen | |
| 5,063,617 | A | 11/1991 | Ward et al. | |
| 5,091,999 | A | 3/1992 | Turner, Jr. | |
| 5,212,840 | A | 5/1993 | Caldwell | |
| 5,638,554 | A | 6/1997 | Corzine | |
| 5,720,753 | A | 2/1998 | Sander et al. | |
| 5,775,863 | A | 7/1998 | Anderson | |
| 5,946,740 | A | 9/1999 | Sorimachi | |
| 6,012,886 | A | 1/2000 | Tanamura et al. | |
| 6,070,295 | A | 6/2000 | Hulsebus | |
| 6,101,640 | A | 8/2000 | Brewer et al. | |
| 6,112,335 | A | 9/2000 | Gaston | |
| 6,338,167 | B1 | 1/2002 | Baker et al. | |
| 6,381,762 | B1 | 5/2002 | Moser | |
| 6,643,851 | B1 | 11/2003 | Janes | |
| 6,754,917 | B1 | 6/2004 | Rhoades | |
| 6,763,529 | B1 | 7/2004 | Richter | |
| 6,807,686 | B1 | 10/2004 | Janes | |
| 7,137,154 | B2 | 11/2006 | Miller et al. | |
| 8,082,603 | B2 * | 12/2011 | Leibfried | 4/234 |
| 2003/0182719 | A1 | 10/2003 | Glesson | |
| 2004/0223829 | A1 | 11/2004 | Barnett et al. | |
| 2006/0260029 | A1 | 11/2006 | Kelly | |
| 2007/0294813 | A1 | 12/2007 | Leibfried | |

FOREIGN PATENT DOCUMENTS

| | | |
|---|---|---|
| CH | 689138 | 10/1998 |
| DE | 43 39 200 | 5/1999 |
| DE | 100 38 601 | 2/2002 |
| FR | 2770388 | 5/1999 |
| JP | 2000-005100 | 1/2000 |
| JP | 2004-101697 | 4/2004 |

OTHER PUBLICATIONS

Final Office Action; In re: U.S. Appl. No. 11/581,900; Dated: Jul. 12, 2011; Applicant: Michael R. Leibfried, (14 pgs.).

First Office Action in Chinese Appln. No. 200680047154.X dated Jan. 8, 2010. (English Translation attached.).

First Office Action issued on Mexican patent application No. MX/a/2008/005165, mailed May 17, 2012 (English translation not available).

International Preliminary Report on Patentability received for PCT/US2007/080176 dated Mar. 18, 2010.

International Search Report and Written Opinion received for PCT/US2006/040618 dated Apr. 23, 2007.

Japanese Office Action (with English Translation) for Application No. 2008-536747, dated Aug. 15, 2011, 16 pages.

Non-final Office Action received for U.S. Appl. No. 11/581,900 dated Dec. 21, 2010.

Non-Final Office Action; in re: U.S. Appl. No. 12/026,206; Dated: May 9, 2011; Applicant: Michael R. Leibfried, (12 pgs.).

Notice of Allowance; in re: U.S. Appl. No. 11/899,891; Dated: Oct. 21, 2011; Applicant: Michael R. Leibfried; (14 pgs.).

Office Action issued on Canadian Application 2,626,750, dated Nov. 14, 2011 (3 pages).

Supplementary Partial European Search Report for European Appln. No. EP06826141.1 completed Jun. 17, 2010.

U.S. Notice of Allowance; in re: U.S. Appl. No. 11/581,900, Dated Oct. 7, 2011, Applicant: Michael R. Leibfried, (15 pgs.).

Office Action on Japanese Application 2008-536747, dated Jun. 29, 2012 (English translation provided).

* cited by examiner

Fig. 3
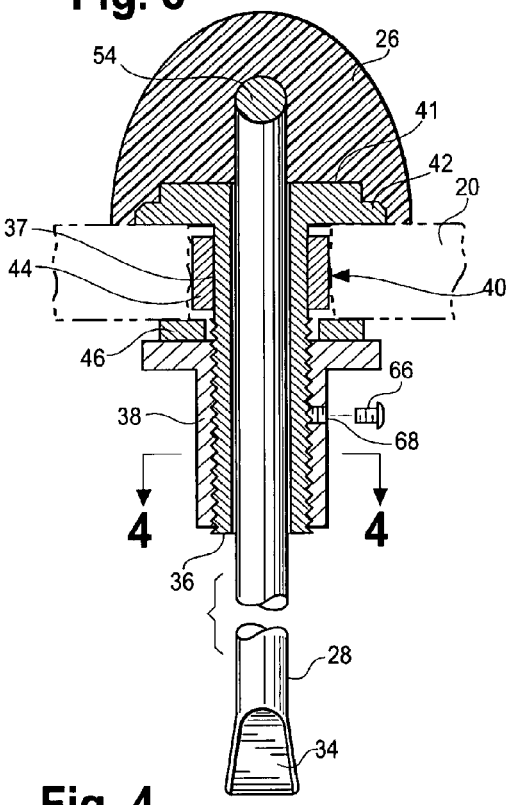
Fig. 6
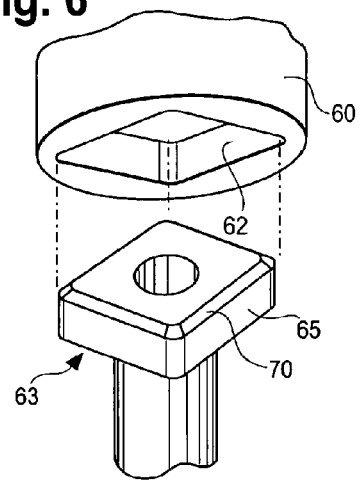
Fig. 7
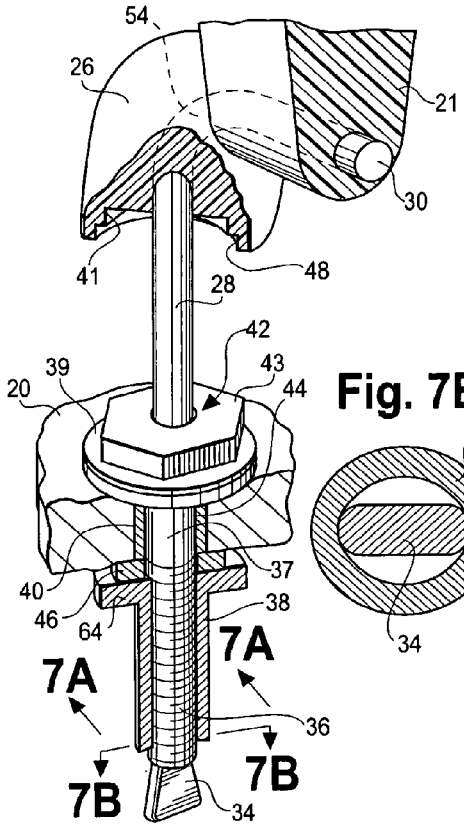
Fig. 4
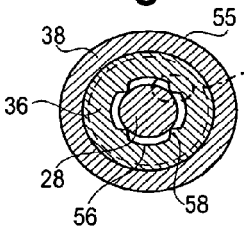
Fig. 5
Fig. 7A
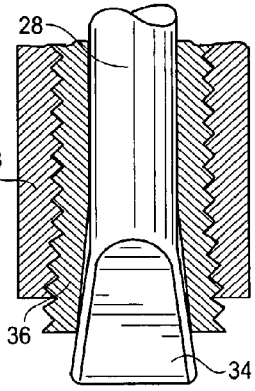
Fig. 7B
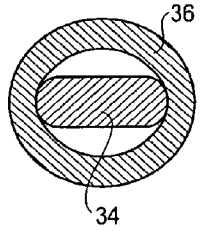
Fig. 5
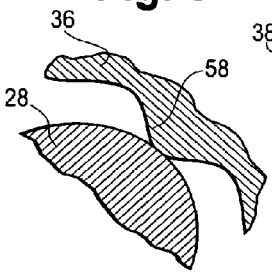

TOILET AND TOILET SEAT MOUNTING SYSTEM

CROSS-REFERENCE TO RELATED APPLICATIONS

This patent application is a Continuation of U.S. application Ser. No. 11/899,891, filed Sep. 7, 2007, issuing as U.S. Pat. No. 8,082,603 on Dec. 27, 2011, which in turn is a continuation in part of Utility patent application Ser. No. 11/581,900 filed Oct. 17, 2006 which claims the benefit of U.S. Provisional Patent Application No. 60/729,084, filed Oct. 21, 2005, the disclosures of all of which are hereby incorporated by reference for any and all purposes.

BACKGROUND OF THE INVENTION

Improving the maintenance, the cleanliness and the sanitation features of conventional toilets and toilet seats has been the subject of many efforts to provide improved toilet seats, toilet bowls and means for connecting them. It has been found that cleaning and sanitizing is complicated by the intricacies of hinge-like interconnections between the pivoted seat ring and the bowl flange of a toilet bowl and by the inconvenient location and the often unsavory condition thereof. In many installations the problems are aggravated by the hinge-like interconnection of a separate seat cover mounted above the seat. Access to the area around those interconnections is difficult and inconvenient and maintenance in that area is often distasteful. Partial solutions to these problems have been suggested by many.

One early effort to gain accessibility to the seat, bowl flange and the mounting area to facilitate maintenance is shown in a 1962 patent, U.S. Pat. No. 3,055,015. Bushings are bolted in the bowl flange apertures and a post extends from the seat through each bushing to connect the seat to the bowl flange. A spring arm on each post engages the bushing to releasably hold the seat in place on the bowl flange. The seat can be released and pulled upwardly to totally remove the seat for maintenance. This approach presents additional problems for maintenance personnel. Typically the unsanitary separated seat assembly must be placed on a remote surface for cleaning and sanitizing. This results in excessive handling and touching of contaminated toilet seats, and subjects additional surface areas to contamination. The open apertures in the bowl flange bushing will collect debris and cleaning materials that are difficult to remove. Moreover, a configuration relying on total separation of the seat assembly from the toilet bowl will be more subject to vandalism and theft, especially in commercial applications.

Many years later another approach to the same problems was shown in a 1980 patent, U.S. Pat. No. 4,326,307. In that approach a bolt is secured in each bowl flange aperture with a mounting ball on the bolt above the bowl flange of a residential toilet. This does seal the apertures in the bowl flange against contamination. The seat is supported on each bowl flange ball by a mating hinged fastener. The fastener has a tab and side walls enclosing a slotted socket that engages the associated ball. For maintenance the seat must be pulled from the bowl flange by lifting the tabs and separating the sockets from the balls. Such arrangements also present the problems of excessive handling and touching of the unsanitary detached seat, or seat and cover assembly, and a tendency to place it on remote surfaces for cleaning and sanitizing. Such an approach using releasable fasteners creates additional new problems. The protruding bowl flange ball creates new problems in bowl flange maintenance and the complex exposed fastener with a tab and socket present additional difficulties in removing and remotely resting the seat for maintenance. Other arrangements for detachment and remote storage of a toilet seat are found in the prior art for residential type toilet seats having two hinges, releasably connected to a device secured to the bowl flange.

BRIEF SUMMARY OF THE INVENTION

This invention relates to toilets and toilet seats and more particularly to a toilet seat mounting system that overcomes the shortcomings in the prior art as discussed above. The invention is advantageous both in systems employing only a seat, generally termed "commercial style" and systems utilizing both a seat and seat cover, generally termed "residential style." In accordance with this invention a mounting system is provided that maintains a toilet seat, or seat and cover, in three distinct positions. The system includes apparatus that maintains the seat or the seat and cover in the conventional use position or down position, aligned with and supported on the bowl flange. The apparatus also permits rotation of the cover, or the seat and cover, to a conventional over center storage position. In addition to the conventional use position and the conventional over center storage position, the apparatus of the invention is unique in that it permits controlled upward movement of the seat or the seat and cover to an unconventional elevated over center maintenance position substantially above the bowl flange. This unique position maximizes exposure of the seat, the cover and the bowl for maintenance. This facilitates cleaning the toilet bowl and bowl flange, the toilet seat and cover, the seat mounting system and the surrounding environment, without the need to detach the seat, or the seat and cover, from the toilet bowl fixture.

This invention provides increased stability and rigidity of the seat, or seat and cover, when resting on the bowl flange in both the conventional use position and in the over-center storage position. Moreover, this invention provides positive support of the seat, or seat and cover, in the maintenance position above the bowl flange providing enhanced clearance and access, to better facilitate cleaning and maintenance. This ease of access is accomplished with a system comprising two elongate posts each extending downwardly from an overmolded post holder that rests on the bowl flange. Each post extends downwardly from the mounting apparatus and each is slidably mounted in a respective post receptacle which passes through and is positively secured within a toilet bowl flange aperture. Two vertical posts may be integrated into a single elongate double post holder extending between the bowl apertures. The double post holder may interface with a seat and cover in the conventional way using one or two hinge pins to allow the seat and the cover to rotate independently. Alternatively, the double post holder may be integrally molded with the seat and cover mounting apparatus in a more unconventional method such as a flexible hinge or "live hinge" without hinge pins connecting the double post holder, seat and cover to facilitate independent rotation of the seat and cover to their respective positions.

Each post receptacle is rigidly secured in the bowl flange aperture with a bushing to insure a positive rigid location of the receptacle. Each receptacle is secured and fastened in the respective bowl flange aperture by a cylindrical receptacle retainer. The post receptacles and receptacle retainers provide adequate fastening and support for the entire assembly and close the bowl flange apertures against contamination. The post receptacles are internally configured to insure a sliding fit with the posts. Each post has distal interference means which releasably engages the receptacle to, in turn, releasably support the post in the elevated maintenance position. The seat, or seat and cover, are easily raised to the elevated cleaning and maintenance position and lowered to rest on the bowl flange when and as desired.

BRIEF DESCRIPTION OF THE SEVERAL VIEWS OF THE DRAWINGS

FIG. 3 is a fragmentary view in section of one mounting configuration of the invention with the post cast in a post holder and slidable in a receptacle with retainer;

FIG. 4 is a view in section of the mounting configuration taken on the line 4-4 of FIG. 3;

FIG. 5 is an enlarged view in section of a portion of FIG. 4 as there circled and labeled "FIG. 5";

FIG. 6 is a partial view of an alternate interface between the post holder and the receptacle head of FIG. 3;

FIG. 7 is a fragmentary view partially in section illustrating a mounting configuration similar to that of FIG. 9;

FIG. 7A is a partial view of the flared distal blade of a post, a receptacle and a retainer in section illustrating the interaction of the post and receptacle of FIG. 7 when in the maintenance position and taken along the plane 7A-7A;

FIG. 7B is a view in section of the interaction of the receptacle and flared distal blade of a post taken as indicated by the arrows 7B-7B of FIG. 7;

DETAILED DESCRIPTION OF THE INVENTION

Figure 1:
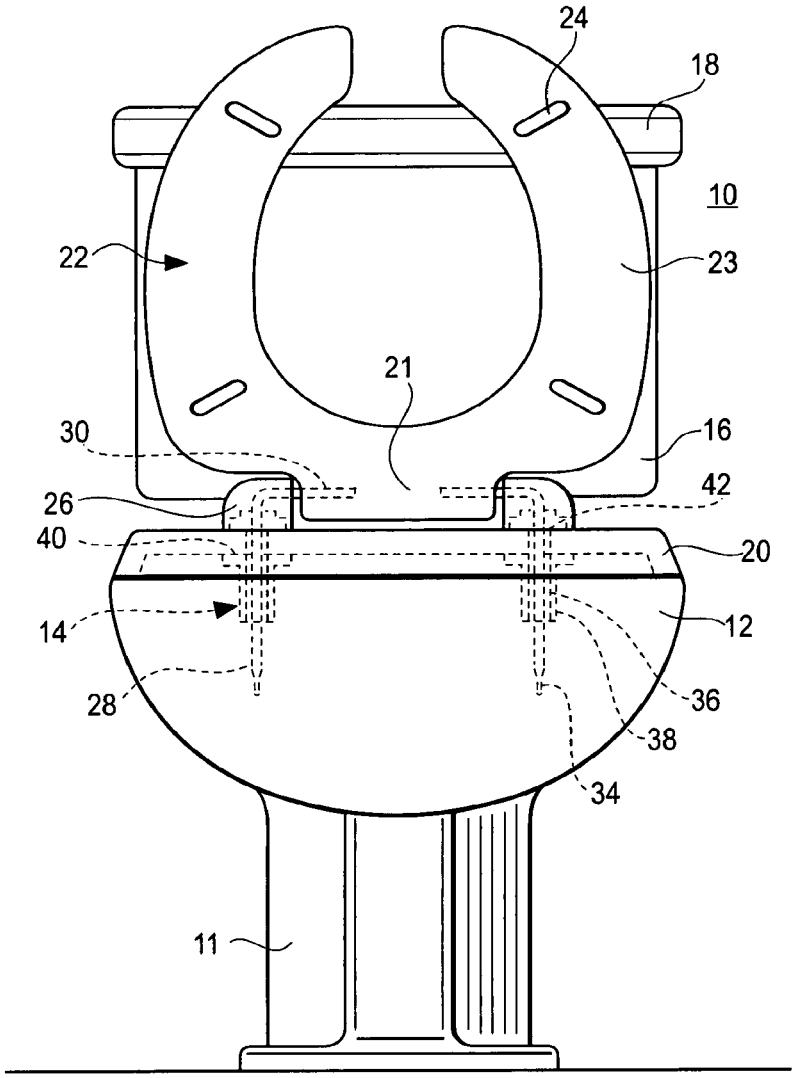
FIG. 1 is a front elevation of a toilet and conventional commercial style toilet seat shown in the conventional over center storage position and with parts of the mounting system of the invention shown in broken lines.

The invention disclosed herein is set forth in the following description, is illustrated in the attached drawings and is the subject of the attached claims. The embodiments of the invention shown and described hereinafter are examples that further illustrate the invention but should not be construed as in any way limiting the scope of the claims. For example, specific configurations are illustrated in the drawings for mounting the seat ring but the mounting means can vary widely within the scope of this invention.

Figure 2:
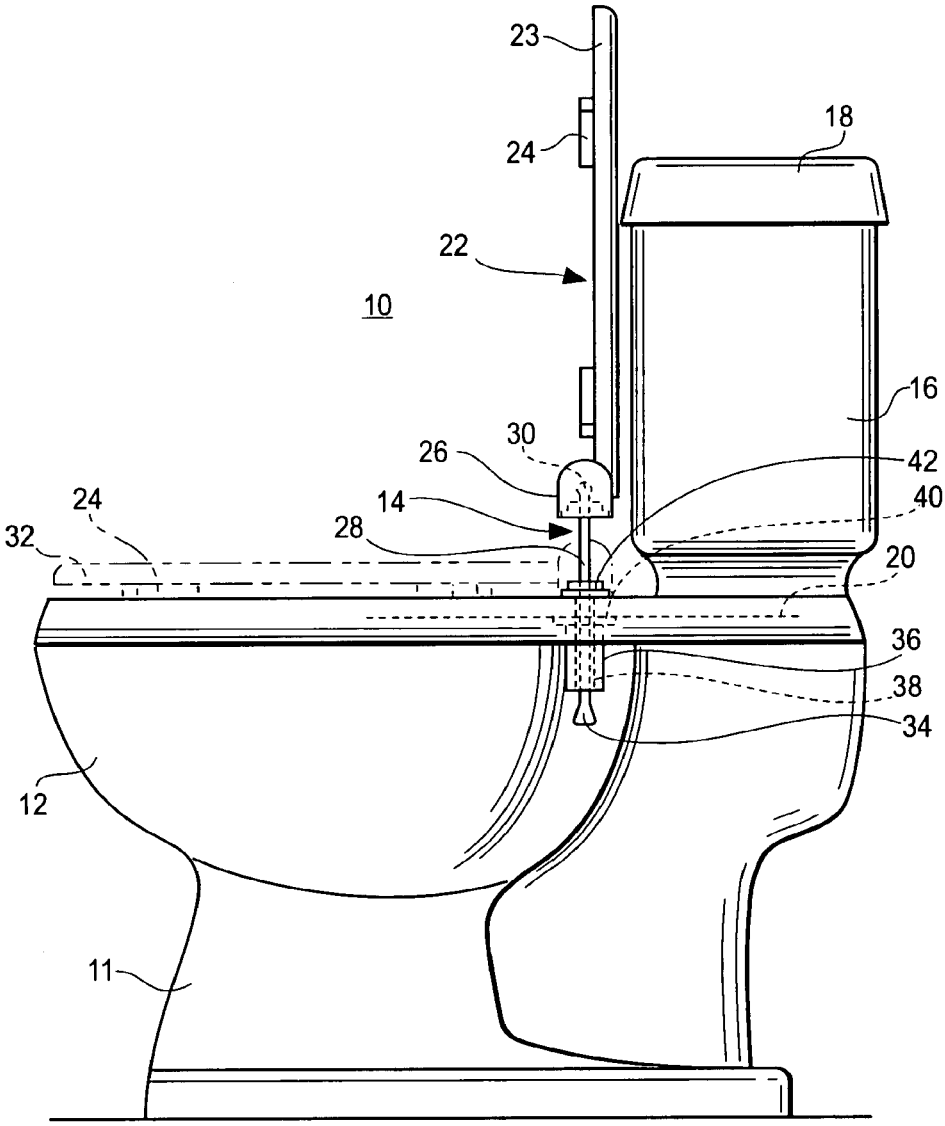
FIG. 2 is a side elevation of the embodiment of FIG. 1 showing the seat in the unconventional over center maintenance position for cleaning and maintenance and with the seat also shown in the conventional use position, but in broken lines.

Referring to the drawings and particularly to FIGS. 1 and 2, a typical commercial toilet 10 is shown having a toilet bowl 12 on a base 11 with a water tank 16 and a tank cover 18. A seat 22 can assume three distinct positions relative to the bowl. The bowl 12 has a bowl flange 20 with apertures 40 and a mounting system secured in the apertures 40 which supports the seat 22. The seat 22 is shown: in the over center storage position on the bowl flange 20 (solid line in FIG. 1); in the use position on bowl flange 20 (broken lines in FIG. 2); and, in the over center raised maintenance position above the bowl flange (solid lines in FIG. 2).

A unique post guidance apparatus 14 supports and facilitates the positioning of the seat 22. As shown in solid lines in FIG. 1, post holders 26 are resting on bowl flange 20 and are connected to seat mounting means 21 by a hinge pin 30 to support seat ring 23 in the over center storage position. As shown in solid lines in FIG. 2 the post holders 26 carrying the seat ring 23 are supported in an elevated over center maintenance position on elongate posts 28 for cleaning and maintenance in accordance with this invention. The post holders 26 and seat 22 are supported in the elevated maintenance position by interaction of the flared distal blades 34 of the posts 28 wedging into the distal portion of the post receptacles 36. Each receptacle 36 has a head 42 that engages the upper surface of bowl flange 20 and a body with external threads that extends through the bowl apertures 40 and substantially beyond the bowl flange 20. A cylindrical retainer 38 engages the underside of the bowl flange and is internally threaded to engage the externally threaded receptacle body 36 to reinforce and rigidly secure the receptacle 36 in place.

In the embodiment shown in FIGS. 1 and 2 the two post holders 26 with hinge pins 30 support the seat 22 for rotation between the over center storage position shown in solid lines in FIG. 1 and the use position of the seat indicated by broken lines 32 in FIG. 2. The seat 22 is lowered from the maintenance position of FIG. 2 to the storage position shown in solid lines in FIG. 1 by applying downward pressure on the seat to release the flared distal blades 34 of the posts from the receptacles 36. The seat 22 is then lowered so that the post holders 26 rest on the bowl flange 20 and enclose the receptacle heads 42. Post holder pockets within the post holders 26 engage the receptacle heads 42 for increased stability in the non-maintenance positions and to facilitate assembly of the system on the toilet flange 20. The seat is raised to the maintenance position by lifting the seat to engage the flared distal blades 34 of the posts 28 with the receptacles 36 with sufficient force to wedge the blades 34 into the receptacles 36 and maintain the seat in the elevated position as will be explained in greater detail hereinafter.

Figure 8:
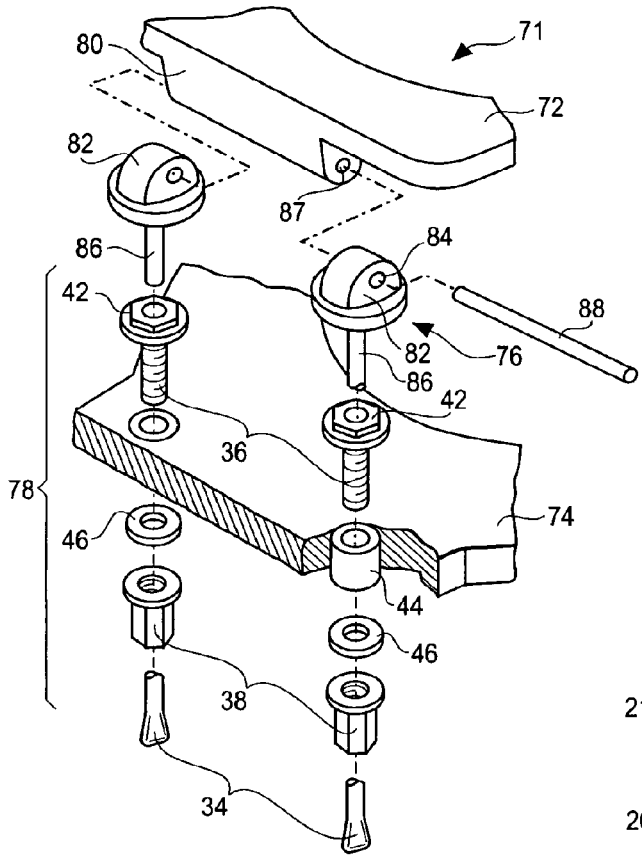
FIG. 8 is a fragmentary exploded view of one commercial style embodiment of the invention with two post holders.
Figure 9:
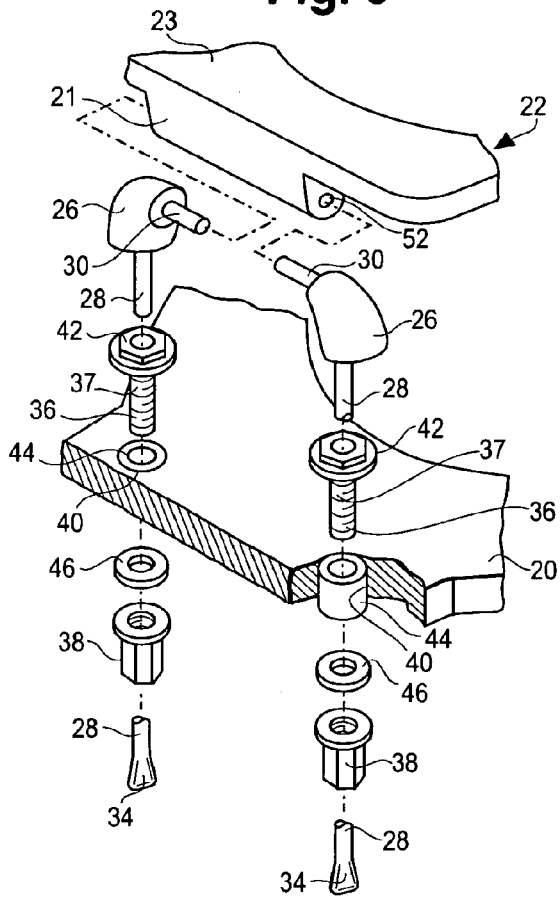
FIG. 9 is a fragmentary exploded view of a second commercial style embodiment of the invention with two post holders.

Application of this invention in various toilet seat and cover configurations can be seen in the illustrations of seat and bowl flange fragments and mounting apparatus in FIGS. 8-16. Referring specifically to FIG. 9, an exploded view of the commercial seat mounting system of FIGS. 1 and 2 is shown in relationship to toilet seat 22 including a bowl flange fragment 20 and a fragment of seat ring 23 and seat mounting means 21. Post holders 26 have subtending posts 28 (shown broken off) and generally horizontal hinge pins 30. As indicated by broken lines, the hinge pins 30 are longitudinally aligned and received in longitudinal apertures 52 in the seat mounting means 21. The hinge pins 30 supported in and extending from post holders 26 and disposed in apertures 52 in the seat mounting means 21 act as a hinge and comprise the seat mounting portion of this embodiment. Pin 30 and post 28 can be separate components or integrally formed as shown in FIG. 1 and explained with respect to FIG. 7.

Receptacles 36 are inserted in toilet bowl flange apertures 40 whereby receptacle heads 42 engage the upper surface of bowl flange 20 and the receptacles 36 extend through and beyond the bowl flange 20 an appropriate distance. The receptacles 36 are threaded over most of their length. The receptacles 36 have a short unthreaded length 37 immediately below the receptacle heads 42 with a reduced diameter to receive a compressible bushing 44 as will be explained in greater detail with respect to FIG. 3. An optional compression washer 46 is placed on each receptacle 36 from below followed by a threaded retainer 38 which is secured against the underside of the bowl flange 20. The retainers 38 reinforce the receptacles 36 and bushings 44 to provide a secure and rigid receptacle assembly and mounting system. The posts 28 have a sliding fit within the receptacles 36 and have sufficient length to permit the seat 22 to assume a position substantially above the bowl flange 20 to facilitate maintenance. The distal blades 34 of the posts 28 are formed to engage the reinforced receptacles 36 and maintain the seat in the elevated maintenance position. In the preferred embodiments the distal blades 34 of posts 28 are progressively flattened and spread by swaging to form wedges or blades. In raising the seat 22 to the maintenance position the flared distal blades 34 engage and slightly distort the receptacles 36, reinforced by the retainers 38. This engagement releasably holds the post 28 and seat 22 in the elevated maintenance position shown in FIG. 2.

This structure and the interface of the receptacles 36 and distal post ends can vary widely. In an alternative post distal end treatment a small section of heat shrink tubing is applied to the bottom of the sliding post and the tubing engages a flared interior wall section at the bottom of the receptacle, creating a releasable friction fit. In another distal post end arrangement the retainer defines a socket to accept the distal post end. The post end may be threaded to receive a threaded end plug tapered to engage the internal retainer wall. The tapered end plug is configured to fit into the retainer socket creating a releasable fit. Other receptacle to distal post end interfaces are disclosed and described in Utility application Ser. No. 11/581,900 and that disclosure is incorporated herein by reference.

FIG. 7 shows a cut away portion of one post and receptacle assembly shown in an extended maintenance position. The partially sectional view of post holder 26 shows the post 28 and the hinge pin 30 integrally formed at a right angle and cast within the post holder 26. This is a convenient, though not required configuration. A portion of seat mounting means 21 is shown pivotally mounted on the hinge pin 30. Receptacle 36 extends through an aperture 40 in bowl flange 20 and is supported thereon by receptacle head 42. Retainer 38 is threaded onto receptacle 36 and has a flange 64 which clamps the retainer 38 through an optional compression washer 46 rigidly in place against the underside of bowl flange 20. Bushing 44 is compressed in aperture 40 to stabilize the entire system. The distal flare 34 of post 28 is forced into engagement with the receptacle 36 whereby the seat is releasably maintained in the extended maintenance position.

FIG. 7A is a view from the direction 7A-7A shown in FIG. 7. FIG. 7A shows the relationship of the flattened and flared distal blade 34 of post 28 wedged into receptacle 36. The receptacle 36 has relatively thin walls to pass through the bowl flange apertures 40. Thus radial pressure of the distal blade 34, if unrestrained, could produce excessive radial distortion of the relatively thin walled receptacle 36. That distortion is controlled by the more rigid retainer 38. FIG. 7B is taken on the line 7B-7B in FIG. 7 and shows the engagement of the flared distal blade 34 of the post with the receptacle 36. However, distortion of the receptacle 36 is barely perceptible when supported by the retainer 38 which can have greater wall thickness.

A right sectional view of a portion of the seat mounting apparatus associated with one aperture 40 of the bowl flange 20 is shown in FIG. 3. Post receptacle 36 extends through the aperture 40 and is supported by receptacle head 42. Post holder 26 supports post 28 which passes through and beyond receptacle 36. The length of the post 28 establishes the desired spacing of the seat 22 above the bowl flange 20 when the seat is in the extended, maintenance position. Receptacle 36 is threaded over most of its length but has unthreaded portion 37 of smaller outside diameter to define a cylindrical cavity within aperture 40. Bushing 44 occupies that cavity. Because bowl apertures 40 can vary in diameter, the bushing 44 is of a somewhat compressible, stretchable polymer such as polyurethane and is configured to fit tightly in the aperture 40 and expand under longitudinal compression to radially fill the cavity and stabilize the seat against lateral movement. Retainer 38 has internal threads over all or most of its length and is coextensive with or slightly shorter than the receptacle upon assembly. It is drawn up tightly against the bowl flange 20 through an optional compression washer 46. Post holder 26 is shown supported on the bowl flange 20 in the use or storage position with a post holder pocket 41 to accommodate the receptacle head 42. The rod that comprises the post has a right hand bend as shown at 54 to form a hinge pin as shown in FIG. 7. The distal blade 34 of post 28 is swaged to provide a flattened tapered blade configuration to engage the receptacle 36 when elevated. An optional set screw 66 fastened in aperture 68 may be provided to insure against any rotation of the retainer 38 relative to receptacle 36 assuring a stay-tight assembly.

FIG. 4 is a sectional view taken on the line 4-4 of FIG. 3 and illustrates a small clearance 56 provided between the inner diameter of receptacle 36 and the metal post 28. This clearance is the result of draft in the internal diameter of the molded polymer receptacle 36 to facilitate removal of a core pin from the receptacle in the molding process. Crush ribs 58, shown exaggerated in FIG. 5, are molded on the inside wall of the receptacle 36 to counteract the effect of draft in the bore of receptacle 36.

Receptacle head 42 can have several configurations. In FIG. 7 the receptacle head 42 has a round lower portion 39 to receive round recess 48 in post holder 26 and a hex crest 43 to facilitate installation of the assembly. The hex crest 43 interfaces with a hex or ribbed cavity 41 in the post holder 26 when the post holder 26 is in the lowered position. This interface of hex crest 43 in cavity 41 locks the receptacle 36 against rotation when installing the retainer 38. This interface also assists in maintaining the post holder 26 in place when in the non-maintenance positions as shown in FIG. 3. FIG. 6 illustrates an alternate example of configurations where the post holder 60 has a square cavity or post holder pocket 62 and the receptacle head 63 has a corresponding square shape 65 with a bevel 70 to facilitate closure alignment of the post holder on the flange.

FIG. 8 is an exploded fragmentary view of another commercial embodiment of the invention showing a seat 71 having a seat ring 72, and seat mounting means 80. The seat 71 of FIG. 8 includes a seat mounting means 80 having a longitudinal aperture 87, post holders 82 having apertures 84 extending there through and aligned with aperture 87, posts 86 extending downwardly from the post holders 82, and receptacle assemblies 78. Receptacle assembly 78 comprises the bushing 44, receptacles 36 with heads 42, retainers 38 and optional washers 46. A hinge pin 88 passes through the post holder apertures 84 and the seat aperture 87. The hinge pin 88 may have a drive fit through the seat mounting means 80 or in one or both of the post holders 82. In the alternative the pin or pins may be appropriately cemented or over-molded in place in the seat mounting means 80 prior to insertion into the post holders 82. The flared distal blades 34 of posts 86 cooperate with the inner surface of the receptacles 36 in the manner already described.

Figure 10:
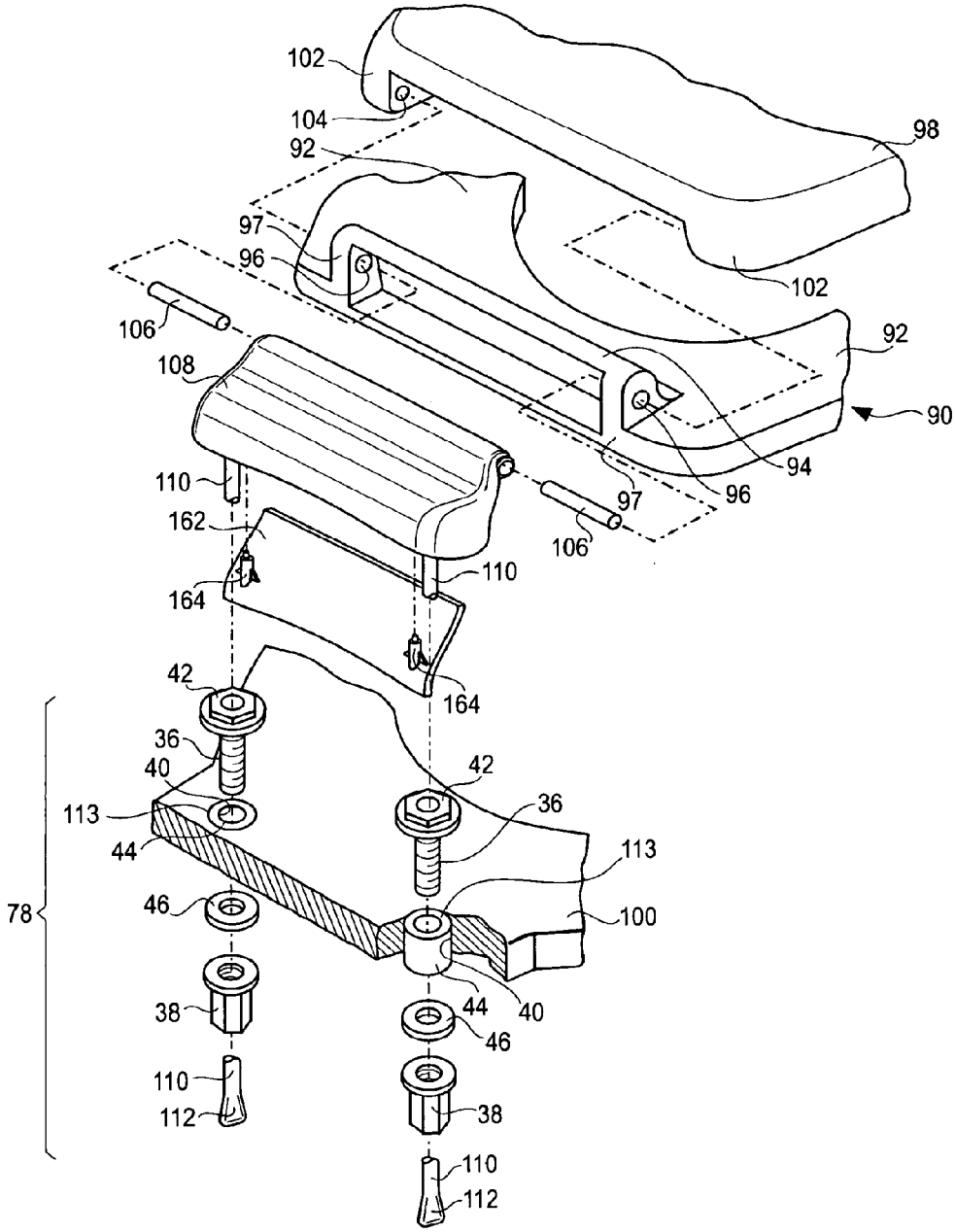
FIG. 10 is a fragmentary exploded view of one residential style embodiment of the invention with a double post holder.

FIG. 10 is an exploded fragmentary view of a residential embodiment of the invention that has a seat 90 and a seat cover 98 independently mounted for pivotal support on a toilet bowl flange 100. The seat comprises a seat ring 92 and seat mounting means 94. The seat mounting means 94 includes supporting trunnions 97 which extend transversely above the rear edge of the seat ring 92. The trunnions 97 have aligned apertures 96 to receive hinge pins 106. The seat cover 98 is mounted above the seat 90 and has mounting means 102 with apertures 104 to receive hinge pins 106.

A double post holder 108 supports two parallel posts 110 spaced to fit the apertures 113 in the bowl flange 100. The posts 110 are longitudinally slidable in the receptacles 36 between a use or storage position and maintenance position as previously described in detail with respect to FIG. 3. A shield 162 may be secured to the underside of the double post holder 108 for aesthetic enhancement and to avoid any contamination or accumulation of debris beneath the post holder. The shield 162 is secured under the double post holder 108 with interfit edges and two mounting pins 164 that engage sockets in the underside of the double post holder 108. The flange mounted receptacle assembly 78 is described in detail with respect to FIG. 8. General details of the double post holder 108, the shield 162 and the mounting pins 164 as shown in FIG. 10 are further shown in and described with respect to FIGS. 11A and 12-14.

Figure 11:
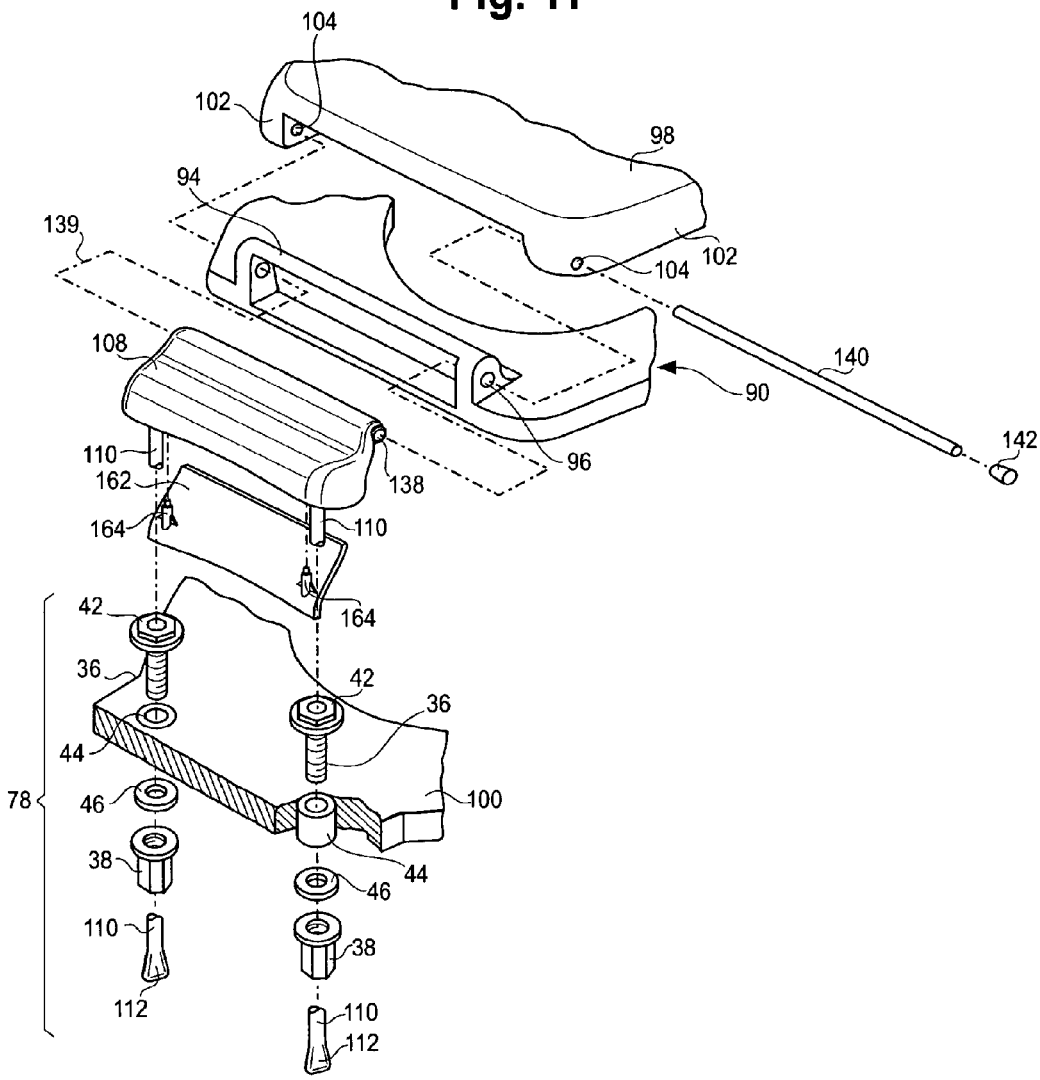
FIG. 11 is a fragmentary exploded view of a second residential style embodiment of the invention incorporating a double post holder.
Figure 11A:
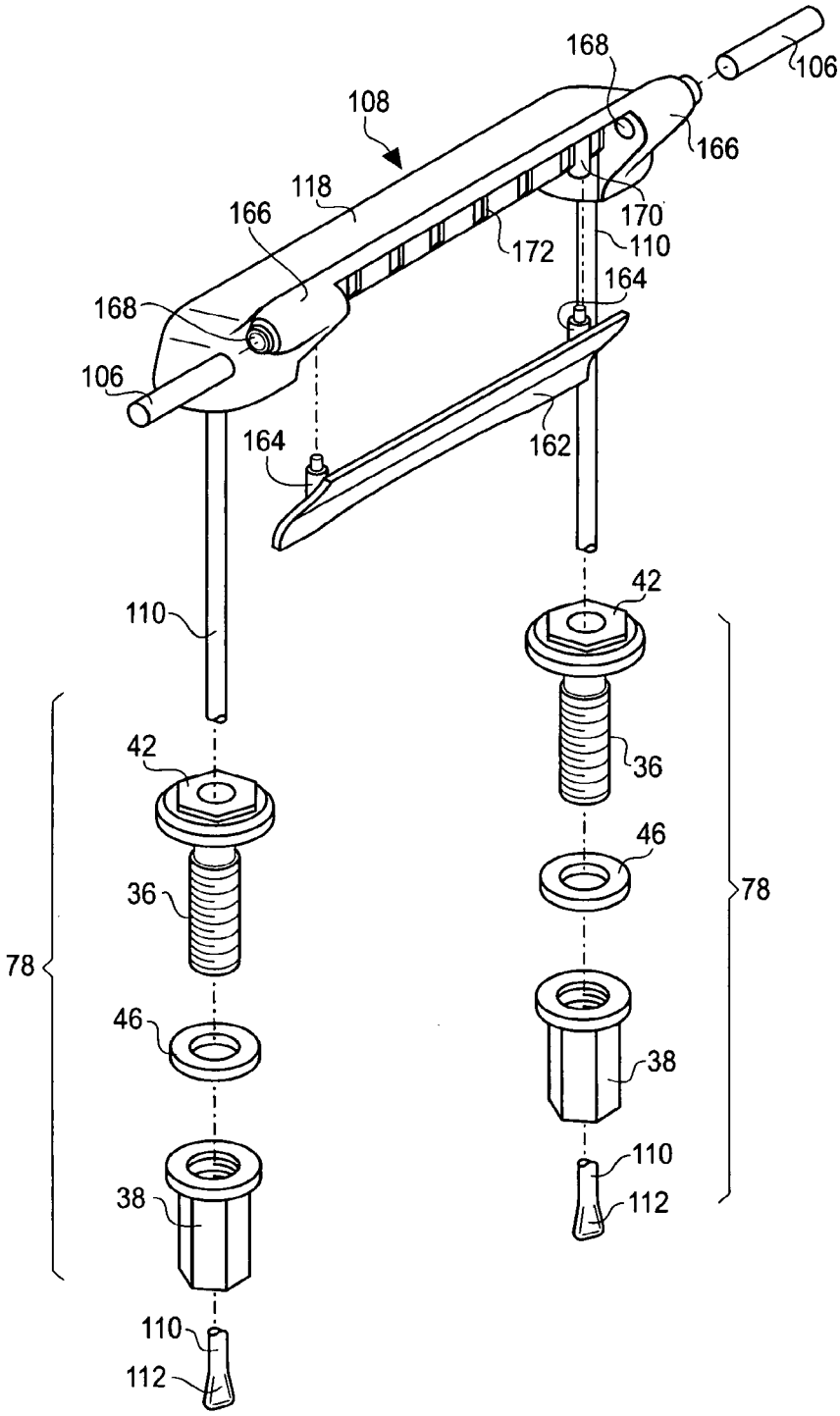
FIG. 11A is an exploded perspective view of the double post holder shown in respect to FIG. 11.

An exploded view of the double post holder 108 and shield 162 appears in FIG. 11A. The double post holder 108 is configured with post holders to support two posts 110 spaced apart and extending from the double post holder central body 118 for accommodation in toilet bowl apertures having standard industry spacing as already described. The posts 110 have distal interference means 112. The double post holder 108 also has a trunnion portion 166 associated with each post 110. Each trunnion 166 defines a hinge aperture 168. The apertures 168 are aligned to receive respective hinge pins 106 which pivotally support the seat and cover for rotation as previously described. The shield 162, configured to enclose the central body 118 of double post holder 108, has two mounting pins 164. The double post holder 108 has two pin sockets 170 spaced to accommodate the shield mounting pins 164 and internally configured to receive and retain the pins 164 upon insertion, thus securing the shield in position. The underside of the central body 118 of double post holder 108 has a ribbed configuration 172 to provide enhanced strength using minimum material. For ease of consumer assembly and to accommodate for the configuration of flared distal blades 112, the receptacles 36 can be mounted on the posts 110 and secured in place by the interference means 112 at the time of manufacture. As best understood from FIG. 10, to install the seat or the seat and cover system on the toilet flange for typical consumer use the installer: installs bushings 44 onto receptacles 36; inserts the posts with preassembled receptacles 36 through the bowl flange apertures; may place the optional washers 46 onto the receptacles 36; threads the retainers 38 unto the receptacles 36; and tightly secures the receptacles 36 against the bowl flange 100 for rigid positioning.

Figure 12:
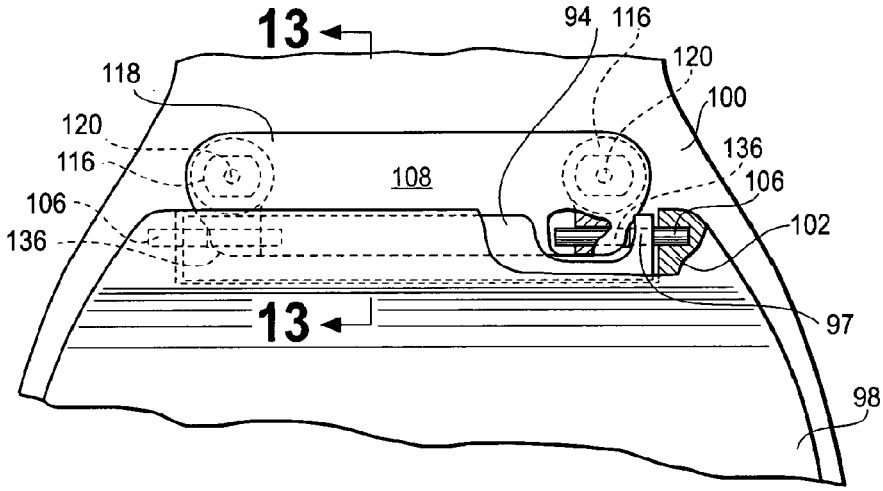
FIG. 12 is a fragmentary top view of a residential style embodiment of the invention incorporating a double post holder and showing details of a portion of the mounting apparatus in broken lines.
Figure 13:
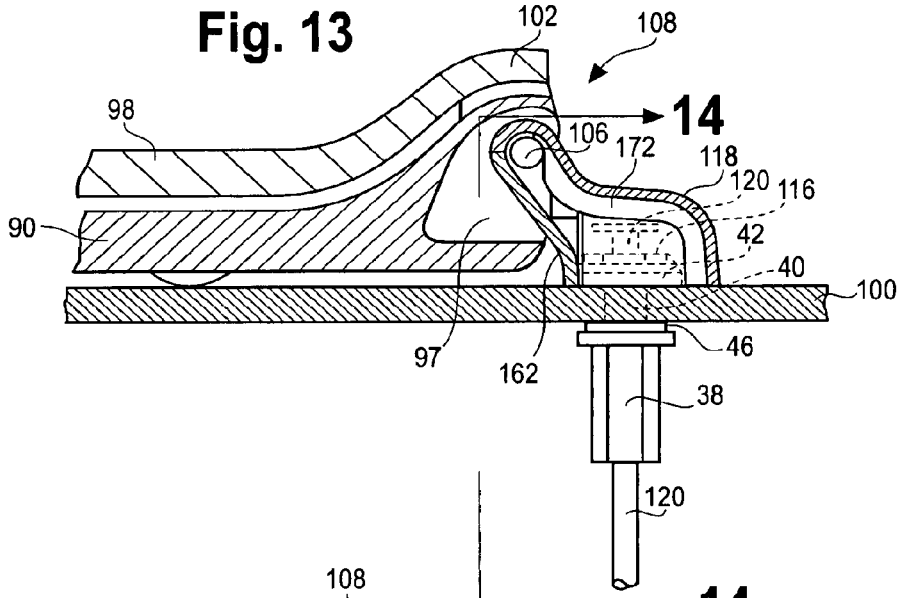
FIG. 13 is a view in section of a fragmentary showing of details of the mounting apparatus taken on the line 13-13 of FIG. 12.

A broken away view of the double post holder 108, the seat mounting means 94 and the seat cover 98 of FIG. 10 are shown in FIGS. 12 and 13. Double post holder 108 is shown resting on the flange 100 and includes two post holders 116 disposed in a central body 118. Posts 120 are cast in and extend downwardly from the post holders 116. In FIG. 12 the central body 118, one post holder 116, the seat mounting means 94 and the cover mounting means 102 are shown partially broken away. Each post holder 116 has a cantilevered arm 136 which supports a hinge pin 106. Seat trunnions 97 of seat mounting means 94 and cover mounting means 102 are pivotally mounted on hinge pin 106 for rotating the seat 90 and cover 98 between the use and the storage positions.

FIG. 13 is a fragmentary sectional view taken on line 13-13 of FIG. 12 and shows a fragment of bowl flange 100 supporting the seat 90 and the seat cover 98 pivotally mounted on double post holder 108. Seat mounting means 97 of seat 90 and cover mounting means 102 of seat cover 98 are mounted on and supported for rotation on hinge pin 106. Shield 162 is secured to the double post holder 108 to cooperate with central body 118 to cover and isolate the space between the post holders 116 and thereby minimize contamination and accumulation of residue in this area. The central body portion 118 has strengthening ribs 172. A post 120 is molded into each post holder 116 and extends through the head 42 of receptacle 36. The head 42 and receptacle 36 are secured in place by optional washer 46 and retainer 38 as described in detail with respect to FIG. 10.

Figure 14:
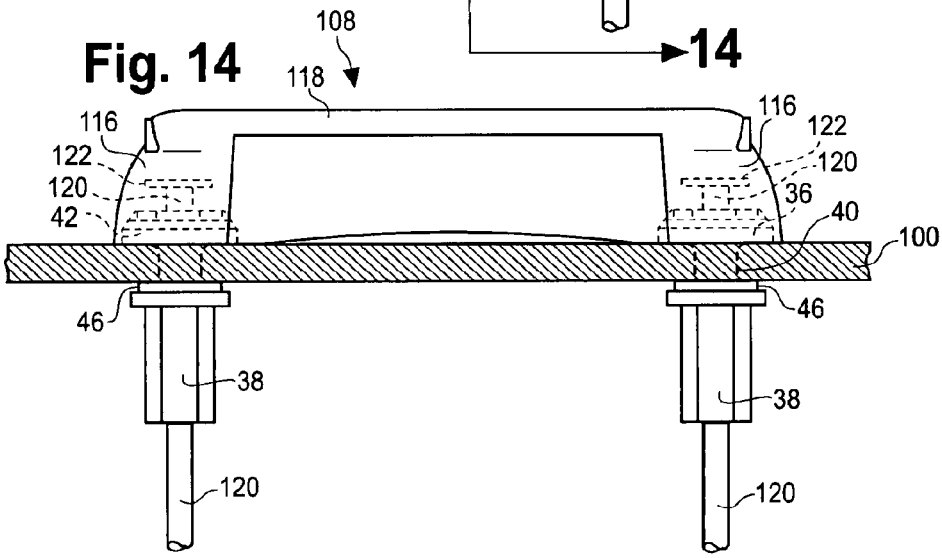
FIG. 14 is a front elevation showing details of the double post holder of FIG. 12.

The front view of FIG. 14 further illustrates the configuration and internal construction of the double post holder 108. The double post holder 108 includes two post holders 116 and a central body portion 118. The central body portion 118 has ribs seen in FIGS. 11A and 13 which are omitted in this view. A post 120 with a post head 122 is cast within each post holder 116 and is shown in broken lines. The posts 120 extend downwardly from the double post holder 108 and have a length appropriate for accommodating extension that raises the seat and cover for cleaning and maintenance.

FIG. 11 is a fragmentary exploded view of another embodiment of the invention similar to the embodiment of FIG. 10. The receptacle assembly 78 is secured to the bowl flange 100 as previously described. The double post holder 108 supports posts 110 which extend through the apertures in the receptacles and have swaged distal blades 112 shaped to enable the flared distal blades to engage the receptacle and support the seat and cover in the extended maintenance position also as previously described. The double post holder 108 is constructed as shown in FIGS. 11A, 13 and 14 with an aperture 138 to accommodate a hinge pin 140. Seat 90 has mounting means 94 with apertures 96 and cover 98 has mounting means 102 with apertures 104. Seat apertures 96 and seat cover apertures 104 are assembled in alignment with double post holder aperture 138 as indicated by the broken line 139 to receive hinge pin 140. In this embodiment the hinge pin 140 when assembled extends through the apertures 104 in cover 98, apertures 96 in seat 90 and apertures 138 in the double post holder 108. The pin 140 has a press fit in the double post holder apertures 138 or in all of the apertures and is preferably shortened in length to accommodate a plug 142.

Figure 15:
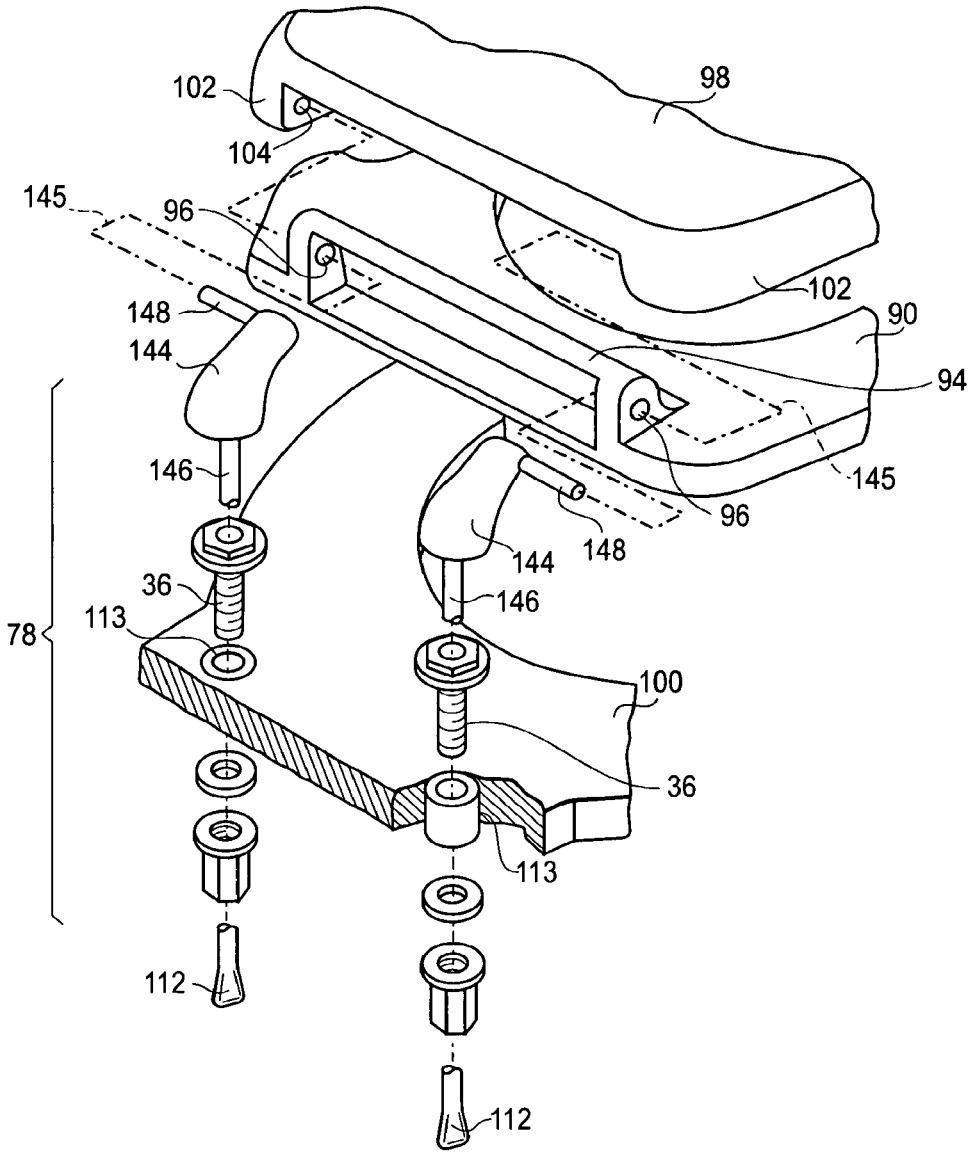
FIG. 15 is a fragmentary exploded view of a third residential embodiment of the invention with two post holders.

FIG. 15 is a fragmentary exploded view of another embodiment of the invention with a seat and cover arrangement similar to that of the embodiment of FIG. 10 but with two separate and independent post holders 144. The seat system is mounted on the toilet bowl flange 100 and includes a toilet seat 90 having seat mounting means 94 with apertures 96 and a seat cover 98 with mounting means 102 having apertures 104. The apertures 104 have a depth whereby they do not extend through the mounting means 102 and are not externally visible in the finished product. The system has receptacle mounting apparatus 78 mounted in the toilet bowl apertures 113 to support the seat 90 and seat cover 98. A post holder 144 is provided for each toilet bowl aperture 113 and each has a post 146 vertically disposed for a sliding fit in the respective receptacles 36 and a hinge pin 148. The post holder 144 can be configured to have the post 146 and hinge pin 148 formed as a single piece and molded in the post holder in the manner shown in FIG. 7. As an alternative posts 146 and hinge pin 148 can be formed separately and, using overmolded or casting techniques, cast into the post holder 144 to insure positive positioning and support. The hinge pins 148 are received in the respective seat apertures 96 and cover apertures 104 as indicated by broken lines 145 prior to insertion of the receptacles 36 in the bowl flange apertures 113.

Figure 16:
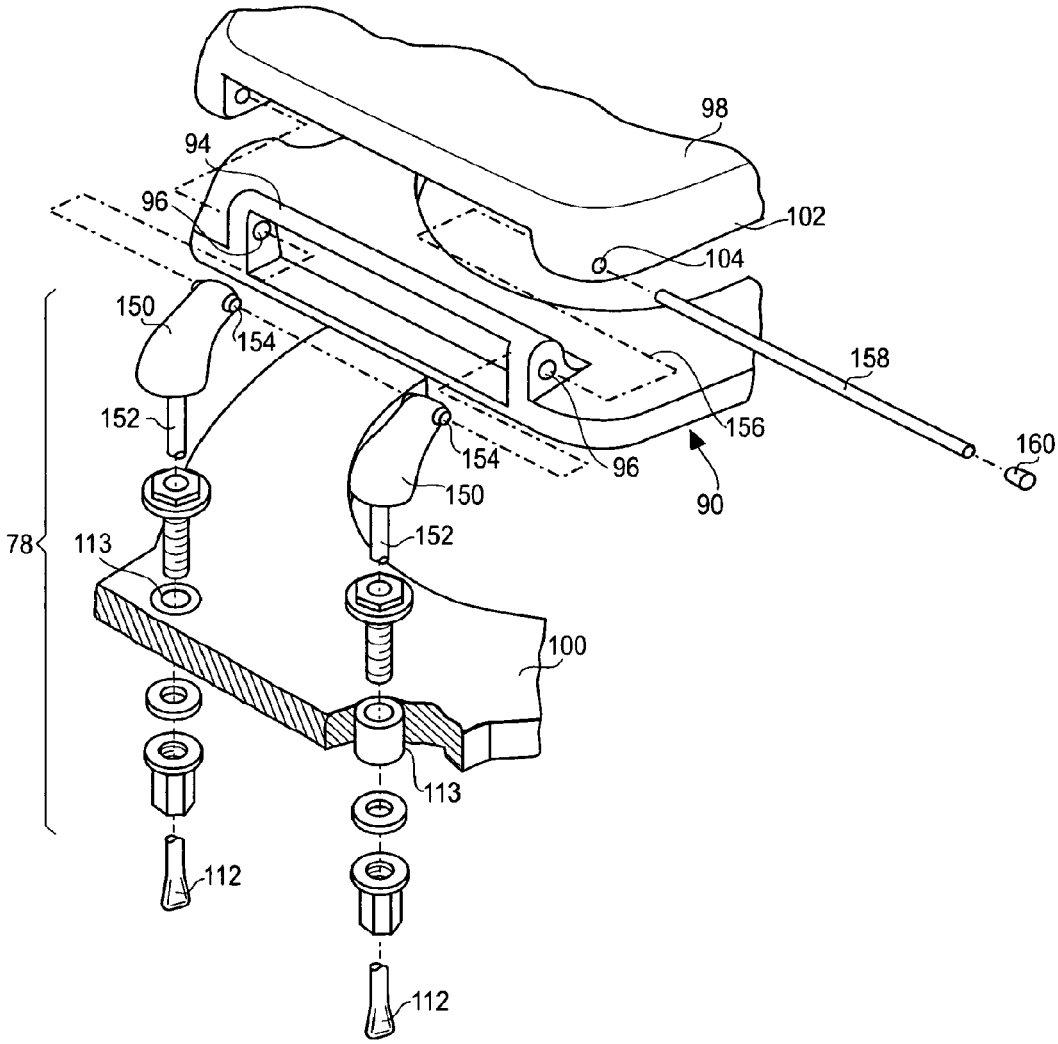
FIG. 16 is a fragmentary exploded view of a fourth residential embodiment of the invention with two post holders.

FIG. 16 is a fragmentary exploded view of another embodiment of the invention similar to FIG. 15 but utilizing a single hinge pin 158. The combination includes a toilet seat 90 having a seat mounting means 94 with apertures 96 and a seat cover 98 with mounting means 102 having apertures 104. The system has a receptacle assembly 78 mounted in the toilet bowl apertures 113 to support the seat 90 and seat cover 98. A post holder 150 is provided for each aperture 113. Each post holder 150 supports a post 152 and has an aperture 154 to receive a hinge pin 158. As described above, each post 152 is preferably molded in a polymer post holder 150 as is known in the art. The various components function together and are assembled for use as indicated by the broken line 156. A hinge pin 158 is then inserted through the apertures in cover 98, seat 90 and post holders 150. It is preferable to provide a drive fit between the pin 158 and all of the apertures. The length of pin 158 is selected to accommodate a cap 160 inserted in the end of each seat cover aperture 104.

A. A toilet comprising: a toilet bowl having a bowl flange with apertures; a toilet seat including a seat ring and seat mounting means, and seat mounting apparatus; said seat mounting apparatus including said seat mounting means, post holders overlying the flange apertures, connecting means joining said seat mounting means and said post holders to permit rotation of the seat ring between a generally horizontal use position and an over center storage position, and an elongate post secured to and extending downwardly from each of said post holders; a post receptacle positively secured in each of the bowl flange apertures and extending there beyond; and, a cylindrical receptacle retainer surrounding and engaging each receptacle over most of its length and engaging the underside of the bowl to positively secure the receptacle in the bowl flange aperture; said posts passing through and beyond the receptacles, configured to permit the seat to be slidably elevated above the bowl flange to a maintenance position, and having distal means configured to engage the receptacle in the maintenance position and to releasably support the post in said position for cleaning and maintenance.

B. A system for supporting and selectively positioning a toilet seat including seat mounting means and a seat ring configured to rest on a toilet bowl flange having apertures, said system comprising: seat mounting apparatus including the seat mounting means, post holders overlying the bowl flange apertures, connecting means joining said seat mounting means and the post holders to permit rotation of the seat ring between a generally horizontal use position and an over center storage position, and an elongate post secured to and extending downwardly from each of said post holders; a post receptacle positively secured in each of the bowl flange apertures and extending there beyond; a cylindrical receptacle retainer surrounding and engaging each receptacle over most of its length and engaging the underside of the bowl to positively secure the receptacle in the flange aperture; said posts passing through and beyond the receptacles, configured to permit the seat to be slidably elevated above the bowl flange to a maintenance position and having distal means configured to engage the receptacle in the maintenance position and to releasably support the post in said position for cleaning and maintenance.

C. The toilet of claim 1 including a seat cover having cover mounting means, said cover overlying said seat in the use position wherein: said mounting apparatus includes said cover mounting means; and said connecting means joins said seat, cover and post holders to permit independent rotation of said seat ring and said seat cover between generally horizontal positions on said flange and over center storage positions.

D. The system of paragraph B including a seat cover having cover mounting means, said cover overlying said seat in the use position wherein: said mounting apparatus includes said cover mounting means; and said connecting means joins said seat, cover and post holders to permit independent rotation of said seat ring and said seat cover between generally horizontal positions on said flange and over center storage positions.

E. The toilet of paragraph A including a compressible bushing disposed within each aperture having inside and outside diameters to engage said receptacle and restrain said receptacle against lateral movement relative to said bowl flange.

F. The system of paragraph B including a compressible bushing disposed within each aperture having inside and outside diameters to engage said receptacle and restrain said receptacle against lateral movement relative to said bowl flange.

G. The toilet of paragraph A wherein the post distal means comprises a flared blade of said post.

H. The system of paragraph B wherein the post distal means comprises a flared blade of said post.

I. The toilet of paragraph A wherein the bowl flange has two spaced apertures and a double post holder extending between said apertures and including said post holders.

J. The system of paragraph B wherein the bowl flange has two spaced apertures and a double post holder extending between said apertures and including said post holders.

K. The system of paragraph B wherein the bowl flange has two spaced apertures, a double post holder integrating the post holders and defining an enclosure therebetween overlying said bowl flange to minimize the accumulation of contaminants beneath the post holders.

L. The system of paragraph K wherein said receptacles have receptacle heads engaging the upper surface of said bowl flange and said post holders surround and enclose said receptacle heads whereby said double post holder covers the flange area in the vicinity of said post holders when the seat is in the use or storage position.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A mount for a toilet seat comprising:

a first elongate post configured to be secured to a first post holder;

a second elongate post configured to be secured to a second post holder;

a first hinge pin configured to join the toilet seat and the first post holder;

a second hinge pin configured to join the toilet seat and the second post holder;

a first post receptacle configured to be secured in a first aperture of a toilet bowl flange; and a second post receptacle configured to be secured in a second aperture of the toilet bowl flange;

wherein:

the first and second hinge pins are configured to permit rotation of the toilet seat between a generally horizontal use position and a generally upright maintenance position;

the first and second elongate posts are configured to pass beyond the post receptacles, the first and second elongate posts are configured to permit the toilet seat to be slidably and vertically elevated to a position above the toilet bowl flange, and the first and second elongate posts each comprise a rod having a flattened portion, the flattened portion configured to interfere with the first and second post receptacles to control longitudinal motion of said elongate posts relative to said post receptacles, whereby the toilet seat is configured to rest on said toilet bowl flange and is configured to be raised and releasably supported above the toilet bowl flange for maintenance.

2. The mount for a toilet seat of claim 1 further comprising a receptacle retainer surrounding and engaging each post receptacle and configured engage an underside of the toilet bowl flange.

3. A mounting system for mounting a toilet seat to a toilet bowl flange comprising:

a first elongate post comprising a flattened portion, the first elongate post secured to a post holder;

a second elongate post comprising a flattened portion, the second elongate post secured to the post holder;

a hinge pin joining the toilet seat and the post holder;

a first post receptacle configured to be secured in a first aperture of the toilet bowl flange; and a second post receptacle, the second post receptacle configured to be secured in a second aperture of the toilet bowl flange;

wherein:

the first and second elongate posts are configured to permit the toilet seat to be slidably and vertically elevated to a position above the toilet bowl flange, and the flattened portion of the first elongate post is configured to interfere with the first post receptacle to control longitudinal motion of the first elongate post relative to the first post receptacle;

the flattened portion of the second elongate post is configured to interfere with the second post receptacle to control longitudinal motion of the second elongate post relative to the second post receptacle;

wherein the toilet seat is configured to rest on the toilet bowl flange and is configured to be raised and releasably supported above the toilet bowl flange for maintenance.

4. The mounting system of claim 3 further comprising:

a first receptacle retainer configured to surround and engage the first post receptacle, and configured to engage an underside of the toilet bowl flange; and a second receptacle retainer configured to surround and engage the second post receptacle, and configured to engage an underside of the toilet bowl flange.

* * * * *